US010214044B2

(12) United States Patent
Nobe et al.

(10) Patent No.: US 10,214,044 B2
(45) Date of Patent: Feb. 26, 2019

(54) STAPLELESS BINDING DEVICE AND IMAGE FORMING APPARATUS

(71) Applicant: FUJI XEROX CO., LTD., Tokyo (JP)

(72) Inventors: Yutaka Nobe, Kanagawa (JP); Satoshi Kurihara, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/699,029

(22) Filed: Sep. 8, 2017

(65) Prior Publication Data

US 2018/0272787 A1 Sep. 27, 2018

(30) Foreign Application Priority Data

Mar. 22, 2017 (JP) ..... 2017-055277

(51) Int. Cl.

| | |
|---|---|
| ***B65H 37/04*** | (2006.01) |
| ***B42C 1/12*** | (2006.01) |
| ***G03G 15/00*** | (2006.01) |
| *B42B 5/00* | (2006.01) |
| *B42B 4/00* | (2006.01) |

(52) U.S. Cl.

CPC ..... *B42C 1/12* (2013.01); *B65H 37/04* (2013.01); *G03G 15/6544* (2013.01); *B42B 4/00* (2013.01); *B42B 5/00* (2013.01); *B65H 2301/43828* (2013.01); *B65H 2801/27* (2013.01); *G03G 2215/00848* (2013.01)

(58) Field of Classification Search

CPC ..... B42C 1/12; B65H 37/04; G03G 15/6544

See application file for complete search history.

(56) References Cited

U.S. PATENT DOCUMENTS

| | | | | |
|---|---|---|---|---|
| 8,413,979 | B2 * | 4/2013 | Sato | B65H 37/04 270/58.07 |
| 9,096,091 | B2 * | 8/2015 | Shibasaki | G03G 15/6538 |
| 9,254,621 | B2 * | 2/2016 | Takahashi | B42C 13/00 |
| 9,440,478 | B2 * | 9/2016 | Takahashi | B42B 5/00 |
| 9,764,920 | B2 * | 9/2017 | Abe | B42B 5/00 |
| 9,908,736 | B2 * | 3/2018 | Abe | B65H 37/04 |
| 2010/0202814 | A1 * | 8/2010 | Nakamura | B65H 37/04 399/408 |

FOREIGN PATENT DOCUMENTS

| | | |
|---|---|---|
| JP | 2013-126905 A | 6/2013 |
| JP | 2015-114450 A | 6/2015 |

* cited by examiner

*Primary Examiner* — Patrick H Mackey

(74) *Attorney, Agent, or Firm* — Sughrue Mion, PLLC

(57) ABSTRACT

A stapleless binding device includes a stapleless binding unit that performs a stapleless binding operation to form irregularities in a sheet stack by making forward and backward movements, a moving unit that relatively moves the stapleless binding unit or the sheet stack in a direction along one side of the sheet stack, and a holding unit that holds the sheet stack during the backward movement of the stapleless binding unit. The holding unit holds the sheet stack during the backward movement of the stapleless binding unit before the moving unit moves the stapleless binding unit or the sheet stack.

8 Claims, 5 Drawing Sheets

STAPLELESS BINDING DEVICE AND IMAGE FORMING APPARATUS

CROSS-REFERENCE TO RELATED APPLICATIONS

This application is based on and claims priority under 35 USC 119 from Japanese Patent Application No. 2017-055277 filed Mar. 22, 2017.

BACKGROUND (i) Technical Field

The present invention relates to a stapleless binding device and an image forming apparatus.

(ii) Related Art

There is known an image forming apparatus having a post-processing function of punching or binding sheets after image formation.

SUMMARY

According to an aspect of the invention, there is provided a stapleless binding device including a stapleless binding unit that performs a stapleless binding operation to form irregularities in a sheet stack by making forward and backward movements, a moving unit that relatively moves the stapleless binding unit or the sheet stack in a direction along one side of the sheet stack, and a holding unit that holds the sheet stack during the backward movement of the stapleless binding unit. The holding unit holds the sheet stack during the backward movement of the stapleless binding unit before the moving unit moves the stapleless binding unit or the sheet stack.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Figure 1:
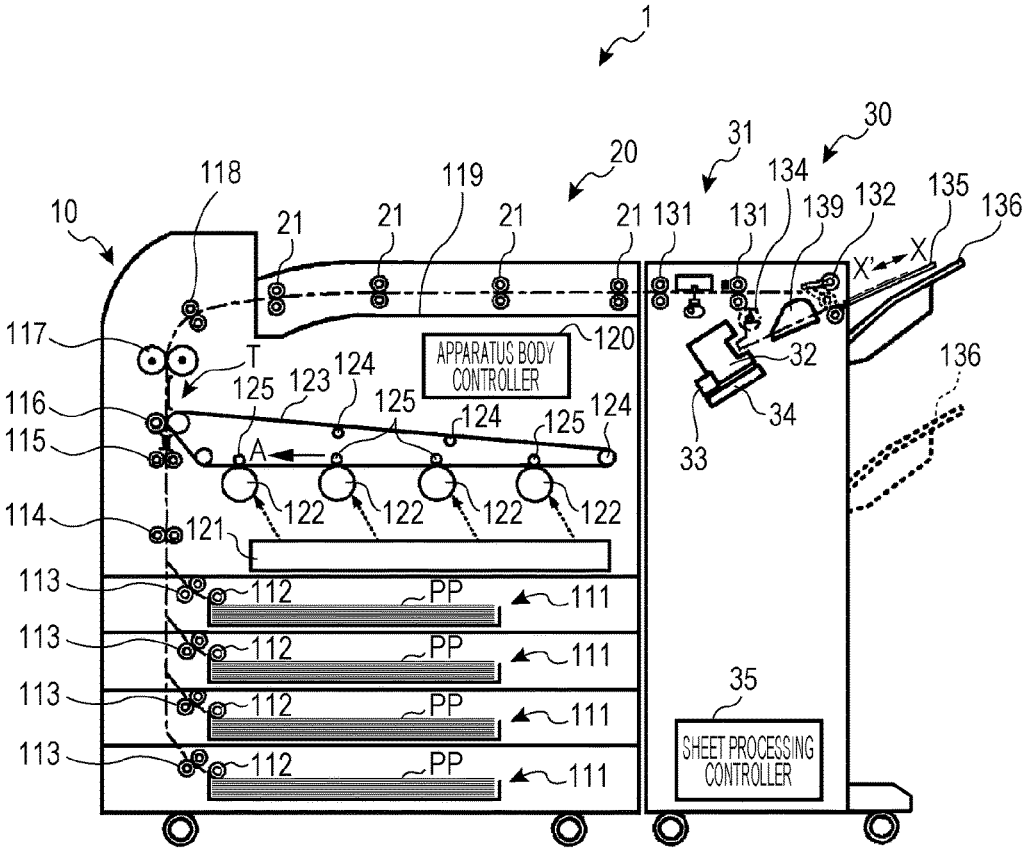
FIG. 1 illustrates an overall configuration of an image forming apparatus according to an exemplary embodiment of the present invention.

FIG. 1 illustrates an overall configuration of an image forming apparatus 1 according to an exemplary embodiment of the present invention.

Referring to FIG. 1, the image forming apparatus 1 includes a printer 10, a sheet transport device 20, and a post-processing device 30.

The printer 10 is an electrophotographic printer that receives an image signal from, for example, an unillustrated host apparatus and forms an image based on the image signals on a sheet.

The printer 10 includes four sheet containers 111. The sheet containers 111 contain sheets PP that are different in paper type, size, and orientation (longitudinal placement or lateral placement). Information about the paper type, size, and orientation of the sheets contained in each sheet containers 111 is preset and stored in an apparatus body controller 120.

When the apparatus body controller 120 receives a print command from the host apparatus, a sheet PP based on the command is taken out by a pickup roller 112 from the corresponding sheet container 111. The taken-out sheet PP is transported by a supply roller 113 and a transport roller 114, and a leading edge of the sheet PP reaches an adjusting roller 115.

On the other hand, an exposure device 121 exposes photoconductors 122 arranged correspondingly to colors C, M, Y, and K, and thereby forms electrostatic latent images on the photoconductors 122. Further, an intermediate transfer belt 123 is stretched by stretching rollers 124 to circulate in a direction of arrow A. The electrostatic latent images formed on the photoconductors 122 are developed into toner images with color toners by unillustrated developing devices, and the color toner images are transferred and superimposed in order onto the intermediate transfer belt 123 by the action of transfer rollers 125.

When the leading edge of the sheet PP reaches the adjusting roller 115, the sheet PP is sent out to a second transfer position T in timing to the toner images on the intermediate transfer belt 123, and the toner images are transferred from the intermediate transfer belt 123 onto the sheet PP by the action of a second transfer roller 116. After the toner images are transferred onto the sheet PP, the sheet PP is further transported, and the toner images are fixed on the sheet PP by being heated and pressed by a fixing roller 117. Thus, an image is formed as a fixed toner image on the sheet PP. After fixing, the sheet PP is further transported by a transport roller 118. When the sheet transport device 20 is not provided, the sheet PP is output onto a sheet output table 119 of the printer 10.

Since the sheet transport device 20 is set on the sheet output table 119 in the image forming apparatus 1, the sheet PP output from the printer 10 is received by the sheet transport device 20, is further transported by transport rollers 21 in the sheet transport device 20, and is then received by the post-processing device 30. The post-processing device 30 will be described later.

A command on one job basis is input from the host apparatus to the printer 10. Specifically, for example, when ten sheets on which image are formed according to corresponding image signals are referred to 1 to 10 pages, a command is given to bind 1 to 10 pages of sheets into one sheet bundle by a stapleless binder 32 and to form ten sheet bundles. For example, in this case, sheets PP are fed out in order from the sheet container 111 containing sheets based on the dimensions of images, and printing is conducted on a total of ten sheet bundles (100 sheets) in the order of an image on the first page, an image on the second page, . . . , and an image on the tenth page. After printing, the sheets are sent into the post-processing device 30 in order through the sheet transport device 20.

The apparatus body controller 120 stores commands input from the host apparatus and set information about sheets, controls the entire printer 10, and communicates with the post-processing device 30. The apparatus body controller 120 also makes operational adjustment between the printer 10 and the post-processing device 30.

The post-processing device 30 includes a puncher 31, a stapleless binder 32, and a sheet processing controller 35 that controls the operations of the puncher 31 and the stapleless binder 32 and communicates with the printer 10. A sheet taken into the post-processing device 30 is transported by transport rollers 131. When a command to punch an edge of the sheet is given, the puncher 31 operates, and the punched sheet is further transported and is then output onto a sheet receiver 136. The sheet receiver 136 is movable up and down between a position shown by a solid line and a position shown by a broken line in FIG. 1, and moves down according to the total thickness of sheets stacked in order on the sheet receiver 136.

When a command is given to bind a sheet stack with the stapleless binder 32 provided in the post-processing device 30, a stapleless binding operation is carried out by the stapleless binder 32 as follows. This stapleless binder 32 performs a stapleless binding operation of binding a sheet stack by forming irregularities in the sheet stack without using a staple.

Figure 2:
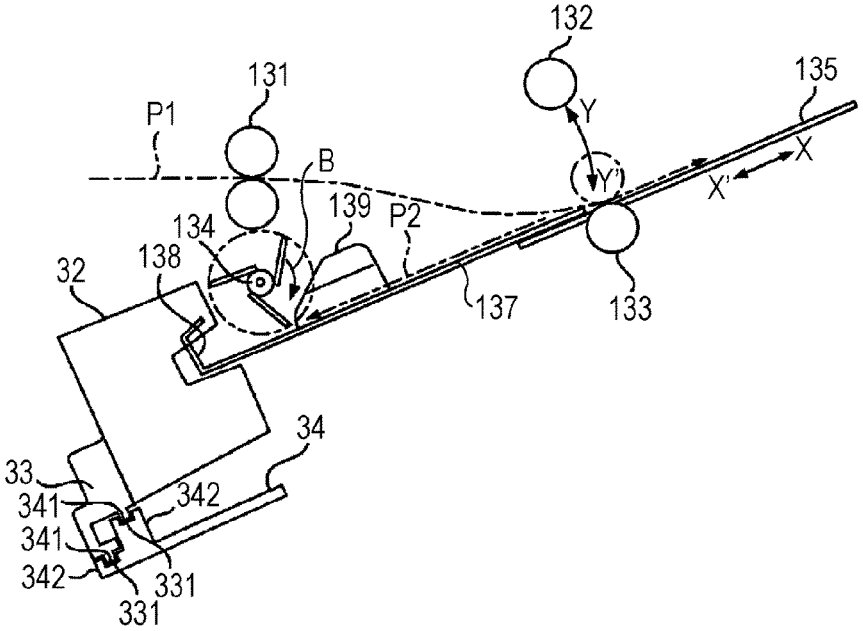
FIG. 2 is an operation diagram of a mechanism around a stapleless binder in a post-processing device illustrated in FIG. 1.

FIG. 2 is an operation diagram of a mechanism around the stapleless binder 32 provided in the post-processing device 30 illustrated in FIG. 1.

This mechanism includes a fixed plate 137 on which sheets are to be placed, and a movable plate 135 movable in a direction of arrow X-X'. In a state illustrated in FIG. 2, the movable plate 135 is advanced in the direction of arrow X. This mechanism further includes an output roller 132 and an opposed roller 133. The output roller 132 is movable up and down in a direction of arrow Y-Y' in FIG. 2. When moving down, the output roller 132 clamps sheets between the opposed roller 133 and the output roller 132 and rotates to output the sheets onto the sheet receiver 136 illustrated in FIG. 1. Here, the output roller 132 is at a position raised in the direction of arrow Y. This mechanism further includes a paddler 134 and lateral receiving plates 139. The paddler 134 rotates in a direction of arrow B to press the sheets against the stapleless binder 32. The sheets pressed against the stapleless binder 32 abut on an abutment wall 138. When the sheets are tapped in the lateral direction by tap plates (not illustrated) disposed between the lateral receiving plates 139 to clamp the sheets from the right and left sides, the sheets tapped in the lateral direction are brought into contact with the lateral receiving plates 139, and are aligned in the lateral direction by the lateral receiving plates 139.

After passing through a region where the puncher 31 illustrated in FIG. 1 is disposed, a sheet advances along a sheet transport path P1 illustrated in FIG. 2. At this time, the output roller 132 is at the position raised in the direction of arrow Y, and the movable plate 135 is at the position advanced in the direction of arrow X. After advancing along the sheet transport path P1, the sheet is placed over the fixed plate 137 and the movable plate 135, is caused by the paddler 134 to abut on the abutment wall 138, and is pressed against the lateral receiving plates 139 by the tap plates (not illustrated), so that the sheet is positioned in the longitudinal and lateral directions. The above-described operation is repeated while a number of (ten in the above example) sheets to form one sheet bundle are transported, and the plural sheets to be one sheet bundle are stacked while being aligned in the longitudinal and lateral directions. The plural stacked sheets are bound into one sheet bundle by the stapleless binder 32. The stapleless binder 32 is provided with a leg portion 33 having two projections 331, and the two projections 331 of the leg portion 33 are fitted in grooves 341 in two rails 342 provided in a guide member 34. The rails 342 extend in a direction perpendicular to the paper plane of FIG. 2. The stapleless binder 32 is movable along the two rails 342 in the direction perpendicular to the paper plane of FIG. 2. Therefore, when binding a sheet stack, the stapleless binder 32 moves along the rails 342, and binds the sheet stack at a specified position or positions, for example, at two positions near the center portion or at one corner portion.

Figure 3:
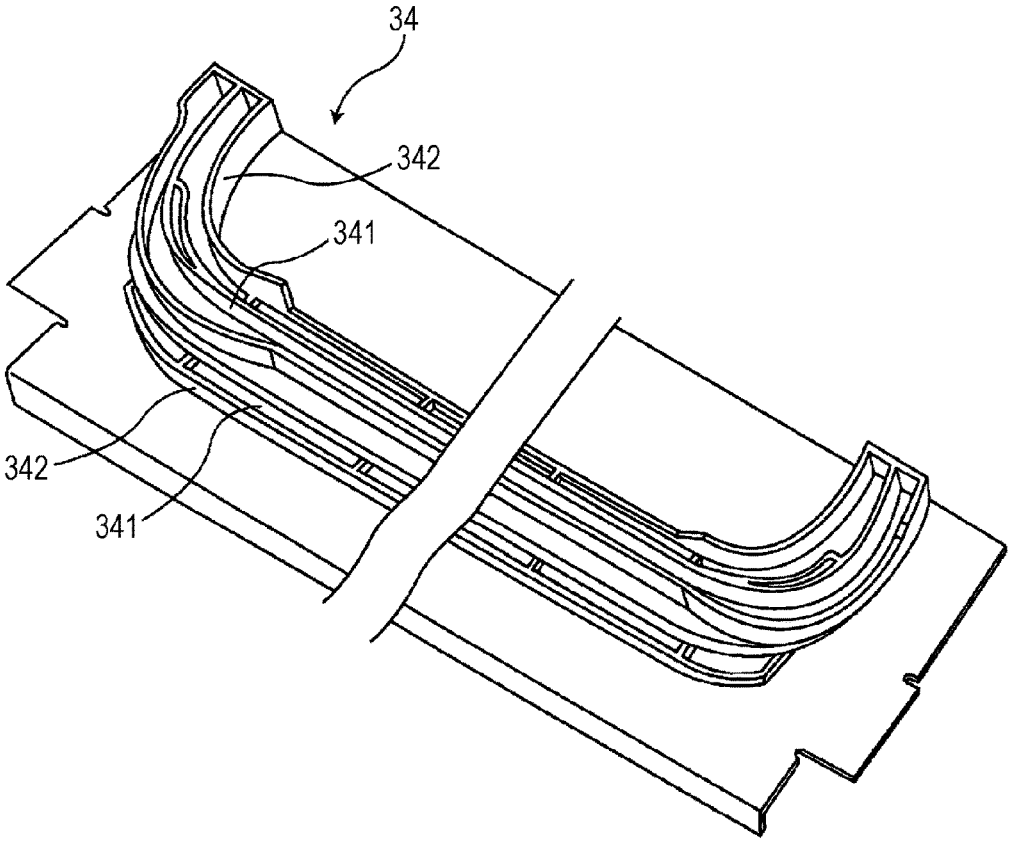
FIG. 3 is a perspective view of a guide member having two rails.

FIG. 3 is a perspective view of the guide member 34 having two rails 342.

The rails 342 of the guide member 34 have their respective grooves 341. The projections 331 of the leg portion 33 illustrated in FIG. 2 are fitted in the grooves 341 to guide the movement of the stapleless binder 32. While the rails 342 extend in the direction perpendicular to the paper plane of FIG. 2 as a whole, they are shaped to be curved near both ends. This shape allows corner portions of the sheets to be bound obliquely to the sheets.

The stapleless binding operation itself using the stapleless binder 32 will be described later. The description with reference to FIG. 2 will be continued.

The output roller 132 moves down in the direction of arrow Y' and clamps a sheet stack between the output roller 132 and the opposed roller 133. The movable plate 135 retreats in the direction of arrow X'. When the binding operation of binding the sheet stack into a sheet bundle is completed, the sheet bundle is output onto the sheet receiver 136 by rotation of the output roller 132.

During the above-described binding operation, for example, a printing operation of the printer 10 (see FIG. 1) is interrupted by adjustment between the printer 10 and the post-processing device 30 so that the next sheet is not further transported from the printer 10.

Hereinafter, a description will be given of phenomena and problems caused in the stapleless binding operation, and a method for avoiding the problems in the exemplary embodiment will be next described.

Figure 4:
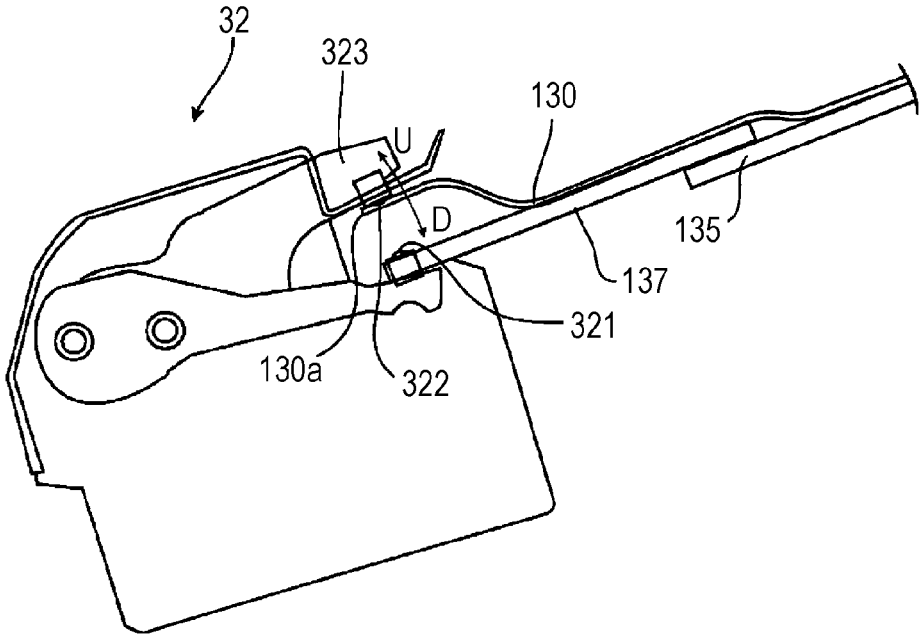
FIG. 4 is an operation diagram of the stapleless binder.

FIG. 4 is an operation diagram of the stapleless binder 32.

The stapleless binder 32 includes lower teeth 321 and upper teeth 322. When an arm 323 having the upper teeth 322 moves forward in a downward direction shown by arrow D from a standby position illustrated in FIG. 4, the upper teeth 321 and the upper teeth 322 clamp a portion of a sheet stack 130 near one side 130*a*, and bite each other to form irregularities in the sheet stack 130. Thus, the sheet stack 130 is bound only by the irregularities without using a staple. After forming the irregularities in the sheet stack 130, the arm 323 moves backward in an upward direction shown by arrow U, and returns to the standby position of FIG. 4.

When the arm 323 moves backward after forming the irregularities in the sheet stack 130, the sheet stack 130 is sometimes lifted with a portion having the irregularities sticking to the upper teeth 322, as illustrated in FIG. 4.

Figure 5:
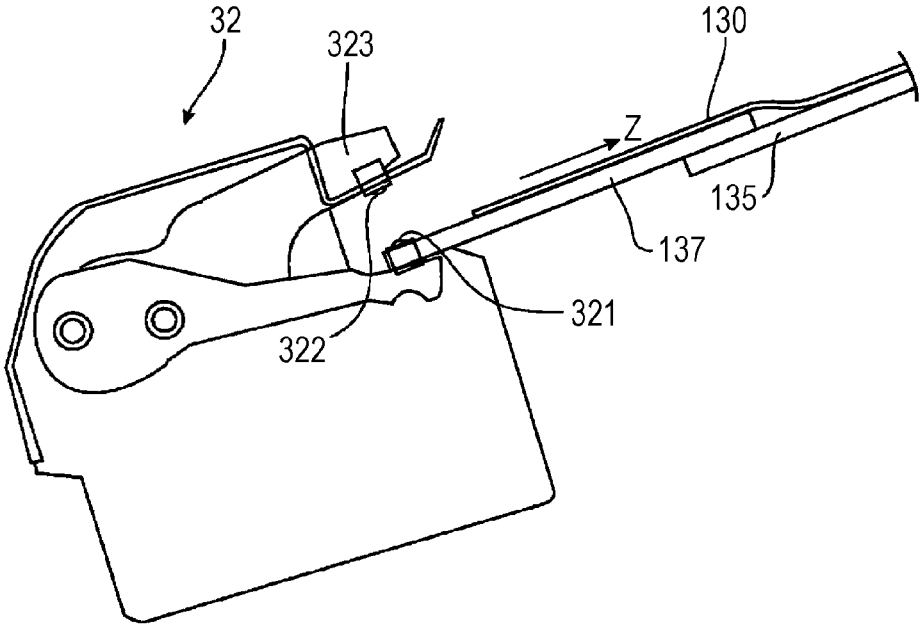
FIG. 5 schematically illustrates the movement of a sheet stack lifted together with upper teeth.

FIG. 5 schematically illustrates the movement of the sheet stack 130 after lifted together with the upper teeth 322.

After lifted while sticking to the upper teeth 322, the sheet stack 130 falls down by its own weight or separates from the upper teeth 322 when the stapleless binder 32 moves laterally along the rails 342 (see FIG. 3). At this time, the sheet stack 130 is sometimes moved in a direction to separate from the stapleless binder 32, that is, in a direction of arrow Z in FIG. 5 in reaction to separation and fall.

Figure 6:
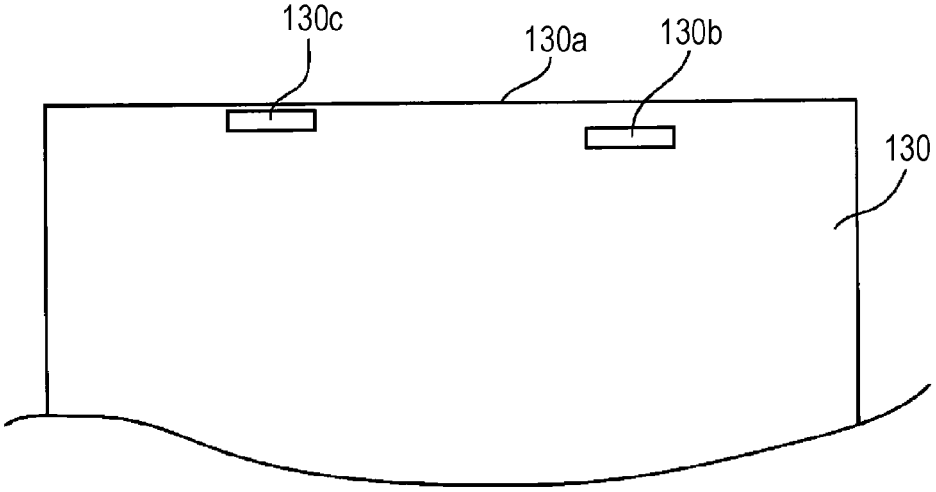
FIG. 6 explains a problem caused when the sheet stack is displaced.

FIG. 6 explains a problem resulting from the movement of the sheet stack.

A description will now be given of a case in which the sheet stack 130 is bound in order at two positions along one side 130*a*. In this case, when the sheet stack 130 moves, as illustrated in FIG. 5, in the first step of the stapleless binding operation for binding at two positions, that is, in the stapleless binding operation before the stapleless binder 32 moves along the side 130*a*, in the second step of the stapleless binding operation after movement, the sheet stack 130 is bound at a position 130*c* closer to the side 130*a* than a binding operation 130*b* in the first step of the stapleless binding operation. That is, the two binding positions 130*b* and 130*c* in the two binding steps are different in the distance from the side 130*a* of the sheet stack 130. If the sheet stack 130 greatly moves in the first step, idling occurs in the second step, and the sheet stack 130 may be bound at only one position of the first step.

Figure 7:
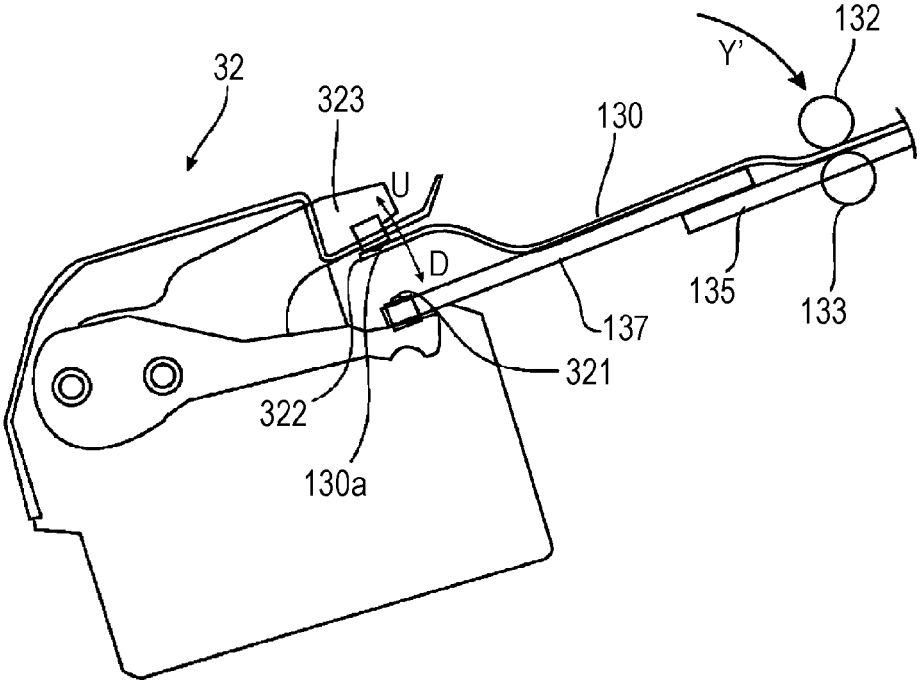
FIG. 7 illustrates a first example of a problem avoiding unit in the exemplary embodiment.

FIG. 7 illustrates a first example of a problem avoiding unit in the exemplary embodiment.

Prior to the forward movement of the arm 323 of the stapleless binder 32 in the direction of arrow D in the first step of the binding operation, the output roller 132 is moved down in the direction of arrow Y' to clamp and hold the sheet stack 130 between the output roller 132 and the opposed roller 133. When the sheet stack 130 is thus held, if the portion of the sheet stack 130 having the irregularities is lifted while sticking to the upper teeth 322 in the backward movement of the arm 323 in the direction of arrow U, the lifted sheet stack 130 falls to the initial position without moving in the direction of arrow Z in FIG. 5.

While the stapleless binder 32 is moved in the lateral direction along the guide member 34 having the rails 342 (see FIG. 3), in addition to the lateral movement of the stapleless binder 32, a unit for moving the sheet stack 130 in the lateral direction is further disposed. To move the sheet stack 130 in the lateral direction, it is necessary to release the sheet stack 130 by lifting the output roller 132 clamping the sheet stack 130 between the output roller 132 and the opposed roller 133 before moving the sheet stack 130 in the lateral direction. This reduces productivity of the sheet stack 130 by the degree corresponding to the time required to move the output roller 132. For this reason, the output roller 132 is controlled to stand by at the raised position just before the sheet stack 130 is output and to be moved down to clamp the sheet stack 130 between the output roller 132 and the opposed roller 133 when the sheet stack 130 is output. When a conventional stapler for binding the sheet stack 130 with a staple is used, the trouble of lifting of the sheet stack 130 does not occur, and there is no idea to clamp the sheet stack 130 between the output roller 132 and the opposed roller 133 by moving down the output roller 132 prior to the backward movement of the arm 323 in the first step of the binding operation from the viewpoint of avoiding the above-described reduction in productivity. In contrast, when the stapleless binder 32 is used, the occurrence of the above-described problem is found. To avoid the problem, the idea is made to clamp and hold the sheet stack 130 between the output roller 132 and the opposed roller 133 by moving down the output roller 132 prior to the backward movement of the arm 323.

Figure 8:
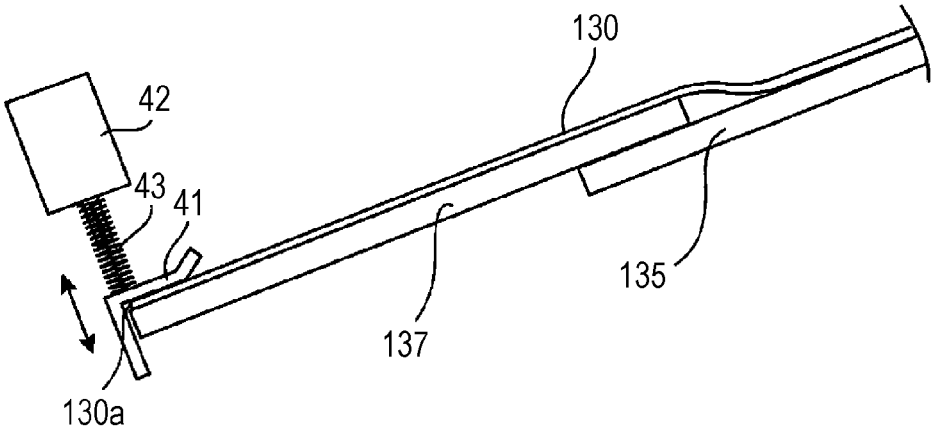
FIG. 8 illustrates a second example of the problem avoiding unit in the exemplary embodiment.

FIG. 8 illustrates a second example of the problem avoiding unit in the exemplary embodiment.

In the second example, a sheet-stack holding member 41 is disposed separately from the output roller 132 illustrated in FIGS. 1 and 2. The sheet-stack holding member 41 is moved up and down by a plunger 42. The sheet-stack holding member 41 is pressed against a portion near one side 130*a* of a sheet stack 130 on a stapleless binding side by the plunger 42 with a spring member 43 interposed therebetween.

The sheet-stack holding member 41 is moved down by the plunger 42 to hold the sheet stack 130 in the first step of the stapleless binding operation of the stapleless binder 32, that is, during the backward movement of the arm 323 at the latest in the stapleless binding operation before the lateral movement of the stapleless binder 32. While the sheet stack 130 is held by the output roller 132 at the position distant from the side 130*a* to be subjected to the stapleless binding operation, as illustrated in FIG. 7, the sheet-stack holding member 41 may be disposed near the side 130*a* of the sheet stack 130 to be bound, for example, the plunger 42 may be supported by the stapleless binder 32.

Figure 9:
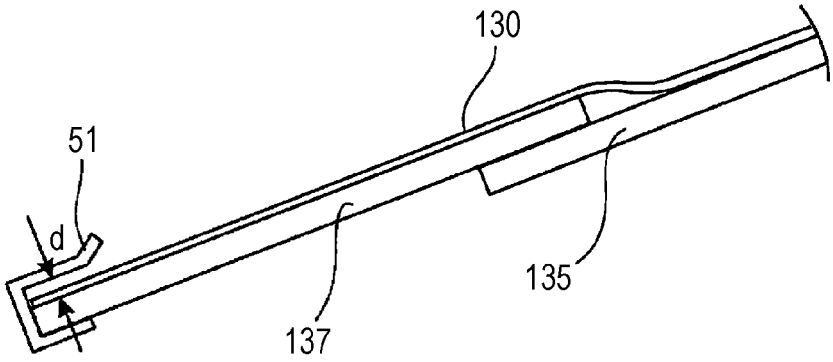
FIG. 9 illustrates a third example of the problem avoiding unit in the exemplary embodiment.

FIG. 9 illustrates a third example of the problem avoiding unit in the exemplary embodiment.

Here, the sheet-stack holding member 41 of FIG. 8, which moves up and down, is replaced with a separation member 51 fixed to the fixed plate 137 to form a small gap between the separation member 51 and an upper surface of the sheet stack 130. When the sheet stack 130 is slightly lifted while sticking to the upper teeth 322 of the stapleless binder 32, it is prevented by the separation member 51 from being further lifted, and falls off the upper teeth 322. A gap d between the fixed plate 137 and the separation member 51 is set at such a value as to minimize the movement of the sheet stack 130 in the direction of arrow Z described with reference to FIG. 5.

Separation of the sheet stack 130 using the separation member 51 of FIG. 9 and holding of the sheet stack 130 using the output roller 132 of FIG. 7 may be used in combination.

While the stapleless binding device according to the present invention is assembled as a part of the post-processing device 30 of the image forming apparatus 1 of FIG. 1 in the exemplary embodiment, the stapleless binding device of the invention may be configured as a separate device independent of the image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A stapleless binding device comprising:

a stapleless binding unit configured to perform a stapleless binding operation to form irregularities in a sheet stack by making forward and backward movements;

a moving unit configured to relatively move the stapleless binding unit or the sheet stack in a direction along one side of the sheet stack;

a holding unit configured to hold the sheet stack during the backward movement of the stapleless binding unit; and a sending unit configured to move into contact with and apart from the sheet stack, and sends out the sheet stack while holding the sheet stack after the stapleless binding operation is finished, wherein the holding unit holds the sheet stack during the backward movement of the stapleless binding unit before the moving unit moves the stapleless binding unit or the sheet stack, wherein the sending unit is operated as the holding unit by holding the sheet stack during the backward movement of the stapleless binding unit before the moving unit moves the stapleless binding unit or the sheet stack.

2. An image forming apparatus comprising:

an image forming section that forms images on a plurality of sheets transported in order; and a stapleless binding section that includes the stapleless binding device according to claim 1, receives the plurality of sheets from the image forming section after image formation, and conducts the stapleless binding operation on a sheet stack composed of the plurality of sheets.

3. The stapleless binding device according to claim 1, wherein the holding unit is configured to move perpendicular to a sheet surface of the sheet stack.

4. The stapleless binding device according to claim 1, wherein the moving unit is configured to move the stapleless binding unit in a direction parallel to a side of the sheet stack in which the stapleless binding operation is performed.

5. The stapleless binding device according to claim 1, wherein the sending unit is a roll.

6. A stapleless binding device comprising:

a stapleless binding unit configured to perform a stapleless binding operation to form irregularities in a sheet stack by making forward and backward movements;

a moving unit configured to relatively move the stapleless binding unit or the sheet stack in a direction along one side of the sheet stack;

a sending unit configured to move into contact with and apart from the sheet stack, and sends out the sheet stack while holding the sheet stack after the stapleless binding operation is finished; and a separation unit configured to separate the sheet stack from the stapleless binding unit during the backward movement of the stapleless binding unit, the separation unit configured to remain fixed when the moving unit moves the stapleless binding unit, wherein the separation unit separates the sheet stack from the stapleless binding unit during the backward movement of the stapleless binding unit before the moving unit moves the stapleless binding unit or the sheet stack, wherein the sending unit holds the sheet stack during the backward movement of the stapleless binding unit before the moving unit moves the stapleless binding unit or the sheet stack.

7. The stapleless binding device according to claim 6, wherein the separation unit is disposed apart from the sheet stack and separates the sheet stack from the stapleless binding unit during the backward movement of the stapleless binding unit.

8. The stapleless binding device according to claim 6, wherein the moving unit is configured to move the stapleless binding unit in a direction parallel to a side of the sheet stack in which the stapleless binding operation is performed.

* * * * *